US009560916B1

(12) United States Patent
Bullard

(10) Patent No.: US 9,560,916 B1
(45) Date of Patent: Feb. 7, 2017

(54) WEB STRAP ATTACHMENT TO METAL FRAME

(71) Applicant: L&P Property Management Company, South Gate, CA (US)

(72) Inventor: Larry I. Bullard, Winston-Salem, NC (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 14/881,763

(22) Filed: Oct. 13, 2015

(51) Int. Cl.
*A47C 7/28* (2006.01)
*A47C 7/22* (2006.01)
*F16B 12/32* (2006.01)

(52) U.S. Cl.
CPC . *A47C 7/22* (2013.01); *A47C 7/28* (2013.01); *F16B 12/32* (2013.01)

(58) Field of Classification Search
CPC ..... A47C 7/22; A47C 7/28; A47C 7/282; A47C 7/285; A47C 7/287; A47C 7/32; F16B 12/32
See application file for complete search history.

(56) References Cited

U.S. PATENT DOCUMENTS 2,667,916 A 2/1954 Burd
2,856,663 A * 10/1958 Elsner ..... B64D 9/00 24/182
2,922,170 A 1/1960 Reggiani
3,039,763 A 6/1962 Staples et al.
3,175,269 A 3/1965 Raduns et al.
3,375,861 A 4/1968 Marlow
3,462,824 A 8/1969 Damiano
3,630,265 A * 12/1971 Biggs ..... A47C 23/26 160/382
4,047,824 A 9/1977 Brokmann et al.
4,456,301 A * 6/1984 Apissomian ..... A47C 7/22 297/440.11
5,645,321 A * 7/1997 Seroldi ..... A47C 31/04 297/218.5
6,081,975 A 7/2000 Norrby
6,116,694 A * 9/2000 Bullard ..... A47C 7/287 267/87
6,263,573 B1 7/2001 Bullard
7,739,775 B2 6/2010 Shimanski
7,946,014 B2 5/2011 Tornero
8,387,217 B1 3/2013 Hinds et al.
9,078,524 B2 7/2015 Bullard
2003/0001424 A1* 1/2003 Mundell ..... A47C 7/16 297/452.56
2005/0200189 A1 9/2005 Schultz et al.
2011/0004371 A1* 1/2011 Bullard ..... A47C 7/285 701/36
2015/0137576 A1 5/2015 Bullard

* cited by examiner

*Primary Examiner* — Philip Gabler
(74) *Attorney, Agent, or Firm* — Wood, Herron & Evans, LLP

(57) ABSTRACT

A seating product is provided which comprises a metal frame, straps of webbing joined to the metal frame with wire hooks. Each of the wire hooks has a main portion inside a loop created in the strap of webbing and two U-shaped portions extending outside the metal frame. Each of the U-shaped portions secures the wire hook in place without the use of holes in the metal frame, thereby reducing manufacturing costs. The metal frame may be made of two pieces joined together, one of the pieces being straight and the other being generally U-shaped.

20 Claims, 7 Drawing Sheets

WEB STRAP ATTACHMENT TO METAL FRAME

FIELD OF THE INVENTION

The present invention relates generally to furniture products and, more particularly, to seating products.

BACKGROUND OF THE INVENTION

Webbing is commonly attached to a furniture frame member by hand. The webbing is typically attached to one side of a wooden frame by staples. The user then stretches the webbing across the frame and staples it to the other side of the wooden frame. This step is repeated for the desired number of pieces of webbing to be attached to the wooden frame. This process is slow and time-consuming. Further, the process does not provide consistent tension of the webbings across the frame. Still further, the process does not provide consistent spacing between the webbings without hand measurement.

Sometimes steel frames are used in seating applications with elastomeric webbing for strength and durability purposes. In certain applications, such as the contract and medical seating industries, a seating structure must be durable enough to pass stringent cycle and drop tests, such as the ANSI/BIFMA X5.1 Office Chair Test or the ANSI/BIFMA X5.4 Lounge and Public Seating Test. For purposes of passing these tests, traditional methods of attaching a strap of webbing to a steel frame have proven to be a weakness in terms of cost and/or durability.

One type of known method of attaching webbing to steel frames is to sew the webbing into a large loop, which would then be stretched over the width or depth of the steel frame. This method requires twice the length of webbing as other methods, which can make it cost-prohibitive.

A more common method has been to attach a strip of webbing to a wire hook, which is then engaged in a hole in the steel frame. The webbing can be sewn to itself around the wire hook or clamped by a sleeve or collar. Most of these wire hooks are shaped like a coat hanger, comprising a flat section passing through the end loop of the webbing, with the two ends bending around the end of the webbing, coming back together in the center to form a triangular shape, then bending back together to form a hook to engage a single hole in the metal frame. This type of attachment hook has created problems in testing. One such problem is when the webbing is only attached to the wire hook by a clamping collar, the impact loads of the cycle or drop test can cause the webbing to slip through the collar, causing a significant or complete loss of support from the webbing. Another problem is when the webbing is secured to the wire hook via a sewn seam, without the clamping collar, then the flat part of the hook can deform under the impact loads of the cycle or drop test, causing a loss of support due to the change in the effective elongation of the webbing. Another problem is when the webbing or strap is sewn to itself around the flat section of the wire hook and the clamping collar is added, the flat section of the wire hook is reinforced, so the slippage and bending problems may be reduced. However, the wire hooks are still prone to breakage during cycle testing, typically in the bends where the wire emerges from the end loop of the webbing.

Another method of attaching webbing to steel frames has been to attach a strip of webbing to a wire hook, which is then engaged in two holes in the steel frame. The webbing can be sewn to itself around the wire hook or clamped by a sleeve or collar. This type of method is shown in U.S. Pat. No. 9,078,524.

Both of these methods of attaching webbing to steel frames requires the steel frame have holes in specific locations for insertion of the hooks located at the ends of the webbing straps. Depending on the application or size of product, the hole pattern in the steel frame must be different.

Consequently, there is a need for a wire hook for use with webbing for seating products which may be used in the end loops of the webbing, which may be used in any location in any desired spacing without the need for holes in the steel frame.

Further, there is a need for a wire hook for use with webbing for seating products which eliminates movement of the wire hooks in holes in the steel frame and therefore, eliminates noise and wear.

SUMMARY OF THE INVENTION

One objective of the present invention is to create an effective durable method of attaching straps of elastomeric webbing to a steel seat frame of a seat assembly. Another objective is to reduce the costs of manufacturing a steel seat frame of a seat assembly to which wire hooks at the ends of straps of elastomeric webbing are secured.

According to one embodiment of the present invention, a seating product comprises a generally rectangular metal frame having four sides, a plurality of webbing straps and wire hooks for attaching opposed ends of each webbing strap to opposed sides of the metal frame. The metal frame may be any number of pieces, including one continuous piece. However, in one preferred embodiment, the metal frame comprises two pieces welded together, one linear piece and one generally U-shaped piece. The linear piece has an L-shaped cross-section. The generally U-shaped piece has a generally rectangular-shaped cross-section with a hollow interior.

Each strap of webbing comprises a flexible piece of elastomeric material having an end loop at each end. A wire hook extends through each of the end loops for securing opposed ends of each strap to the metal frame. The straps of webbing may be made of woven or non-woven materials. In one embodiment, each strap of webbing has a width of two inches. However, the straps may be of any desired width.

Each of the wire hooks is preferably made of one piece of wire, but may be made of multiple pieces of wire. Each wire hook has a straight main portion inside one of the end loops of one of the straps of webbing. Each of the wire hooks further comprises two U-shaped portions, each of the U-shaped portions comprising upper and lower leg portions joined by a connecting portion. The connecting portions may contact an outside wall of one of the sides of the metal frame. The upper leg portions may be spaced above an upper wall of one of the sides of the metal frame. The lower leg portions of the wire hook may hook around a portion of one of the sides of the metal frame, thereby securing the wire hooks in place.

These and other objects and advantages of the present invention will be apparent from the following detailed description of the embodiments which are illustrated in the drawings, in which:

DETAILED DESCRIPTION OF THE DRAWINGS

Figure 1:
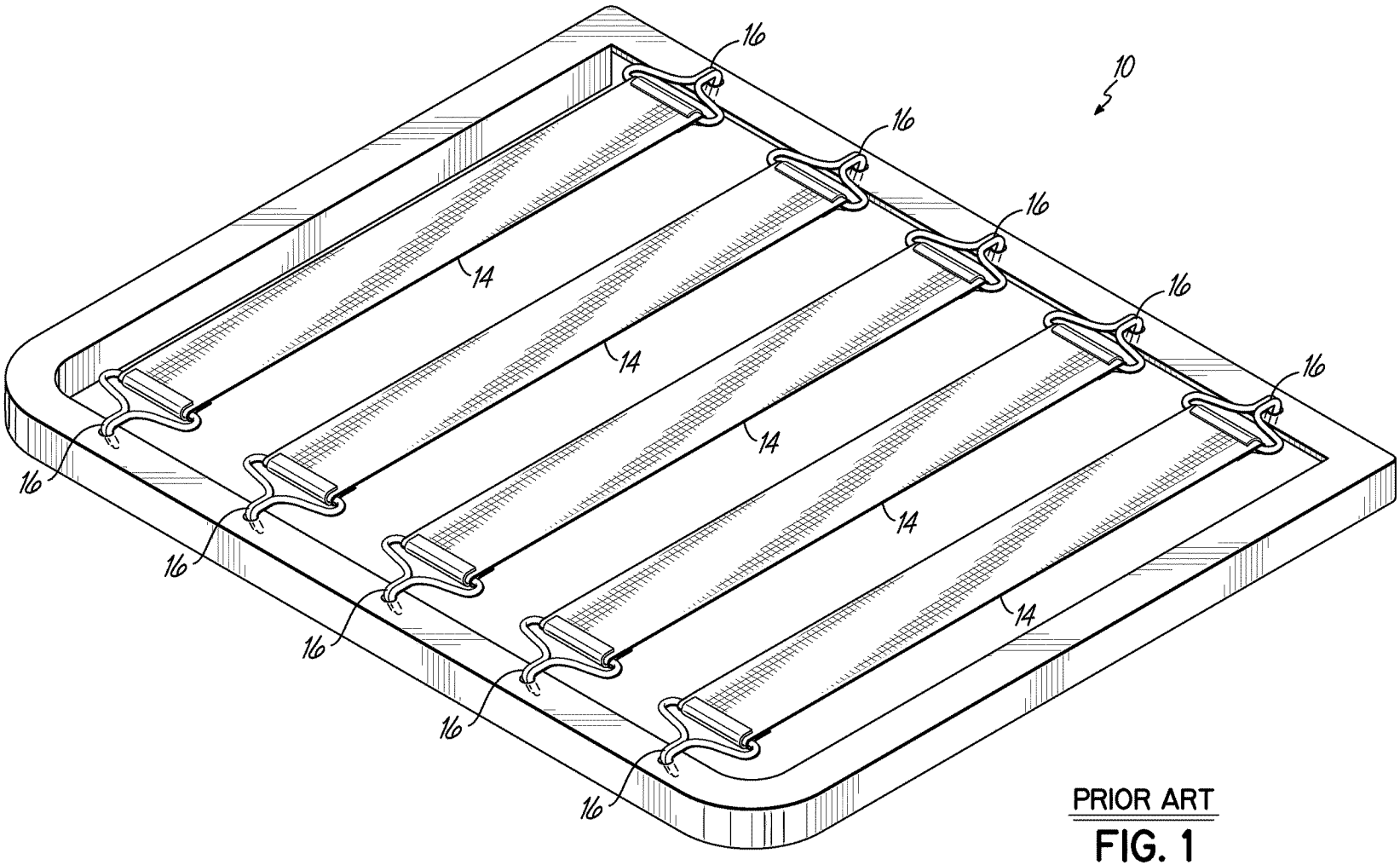
PRIOR ART FIG. 1
FIG. 1 is a perspective view of a portion of a prior art seating product.

Referring to the drawings, and particularly to FIG. 1, a prior art seating assembly 10 is illustrated. The prior art assembly 10 is shown comprising a generally rectangular frame 12 and a plurality of straps of webbing 14 secured to each other with wire hooks 16 shaped like coat hangers. Such prior art wire hooks 16 have proven unsuccessful in passing cycle and drop tests. Such wire hooks are prone to breakage in its bends and use more wire than the wire hooks of the present invention. Another drawback to these prior art wire hooks 16 is that they may directly contact foam or other cushioning materials (not shown) applied to an upper surface of the seat assembly 10 and, over time, may deteriorate these cushioning or padding materials. Another drawback to this type of prior art wire hook 16 is its torsional instability due to the wire hook being secured in one hole in the frame 12. Due to the torsional instability of the straps of webbing 14, the resultant prior art seating product may not be as comfortable and durable as seating products using the wire hooks of the present invention.

Figure 2:
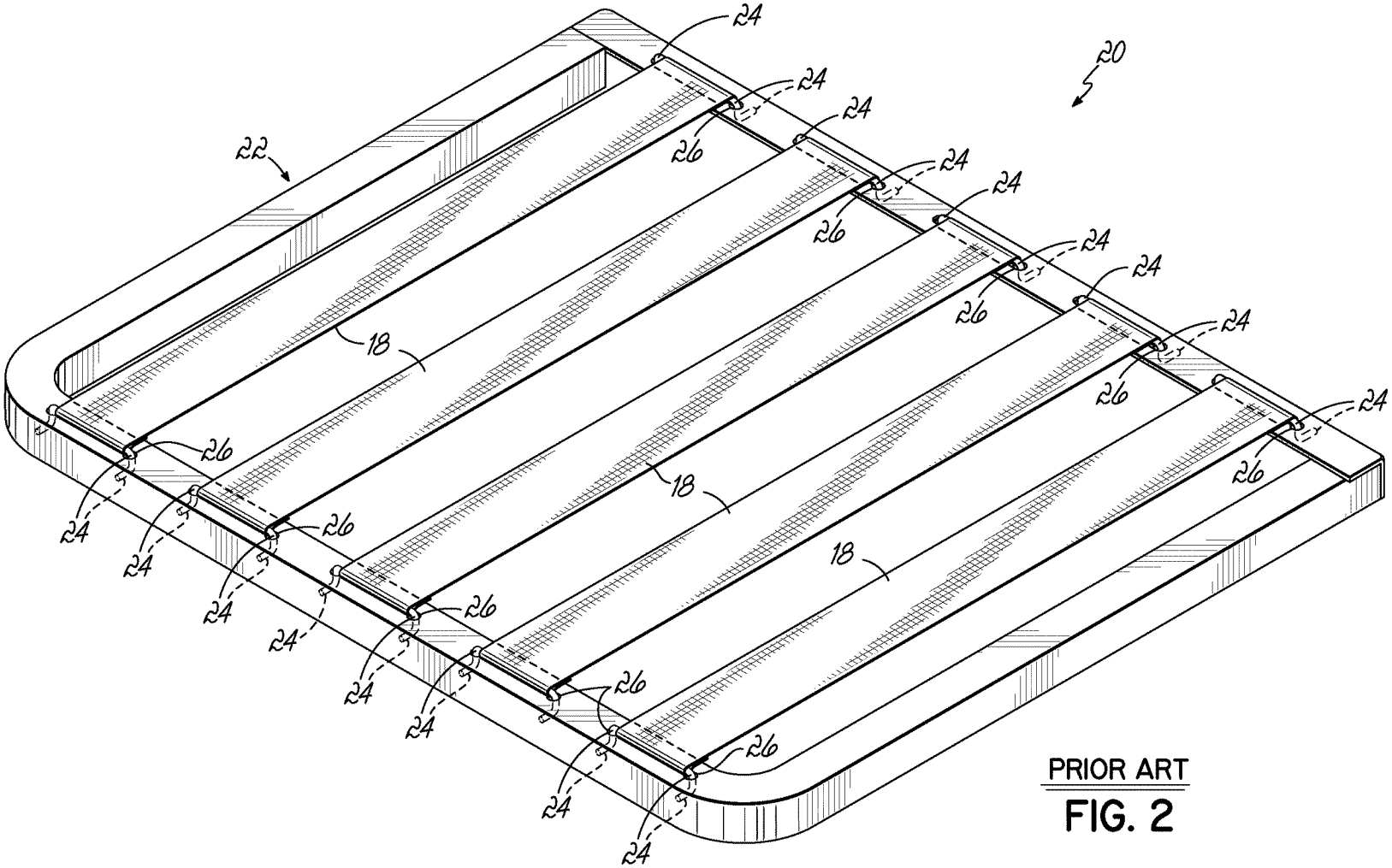
PRIOR ART FIG. 2
FIG. 2 is a perspective view of a portion of another prior art seating product.

FIG. 2 illustrates a portion of another prior art seating assembly 20. The prior art assembly 20 is shown comprising a generally rectangular frame 22 and a plurality of straps of webbing 18 secured to each other with wire hooks 24 inserted in holes 26 in the steel frame 22. Use of the wire hooks 24 requires the generally rectangular frame 22 have holes 26 at specific locations, which increases the cost of the frame 22.

Figure 3:
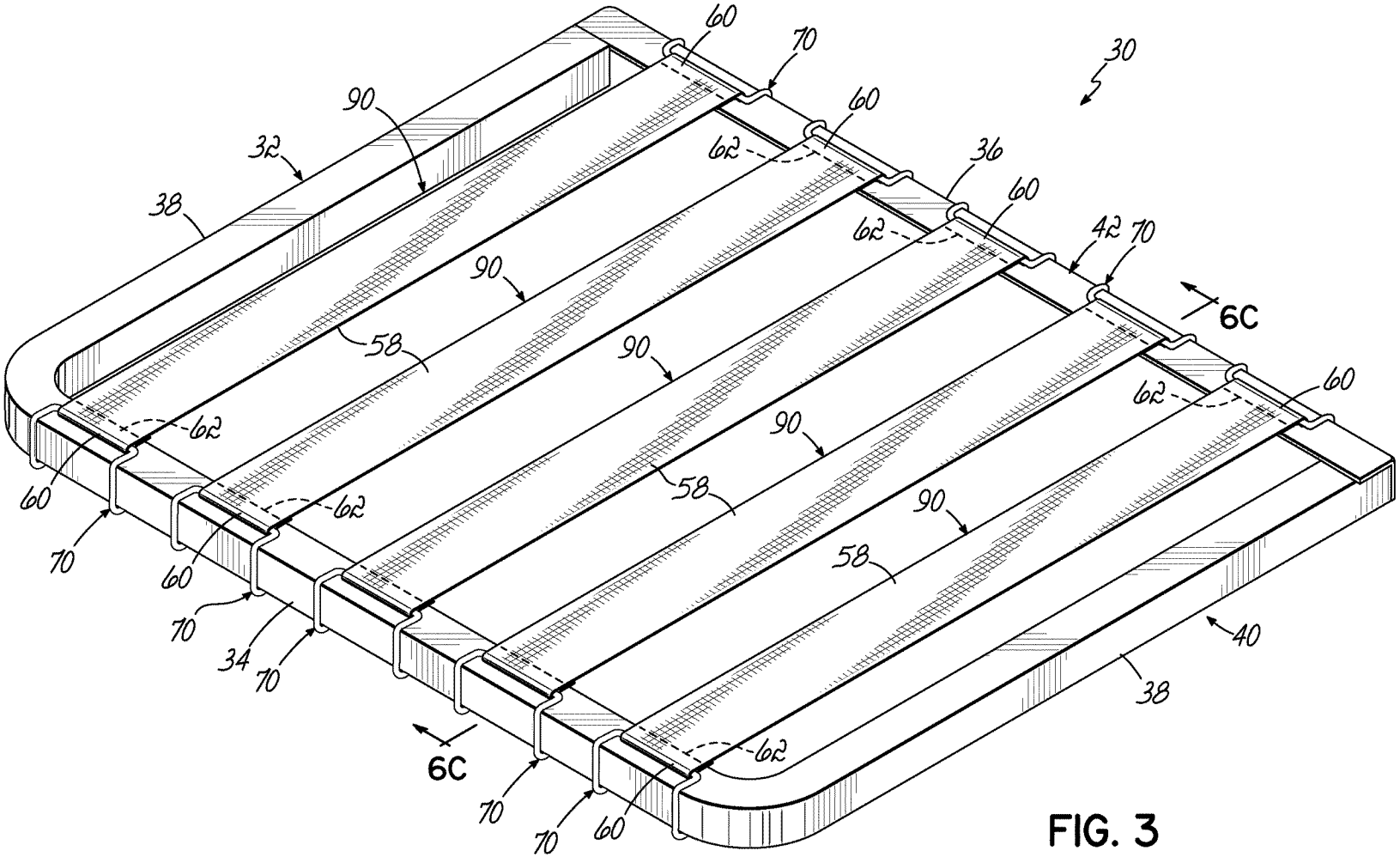
FIG. 3 is a perspective view of the seating product of the present invention.

FIG. 3 illustrates a portion of a seating product 30 made in accordance with the present invention. The seating product 30 may comprise either a seat section or a back section of a seating product or any other component of furniture. The seating product 30 comprises a generally rectangular metal frame 32 having four sides, a front 34, a rear 36 and two opposed sides 38. In the illustrated embodiment, the frame 32 comprises two pieces, a generally U-shaped piece 40 and a linear rear piece 42 welded together. The generally U-shaped piece 40 comprises the front 34 and two sides 38 of the metal frame 32. The linear rear piece 42 comprises the rear 36 of the metal frame 32.

Figure 5:
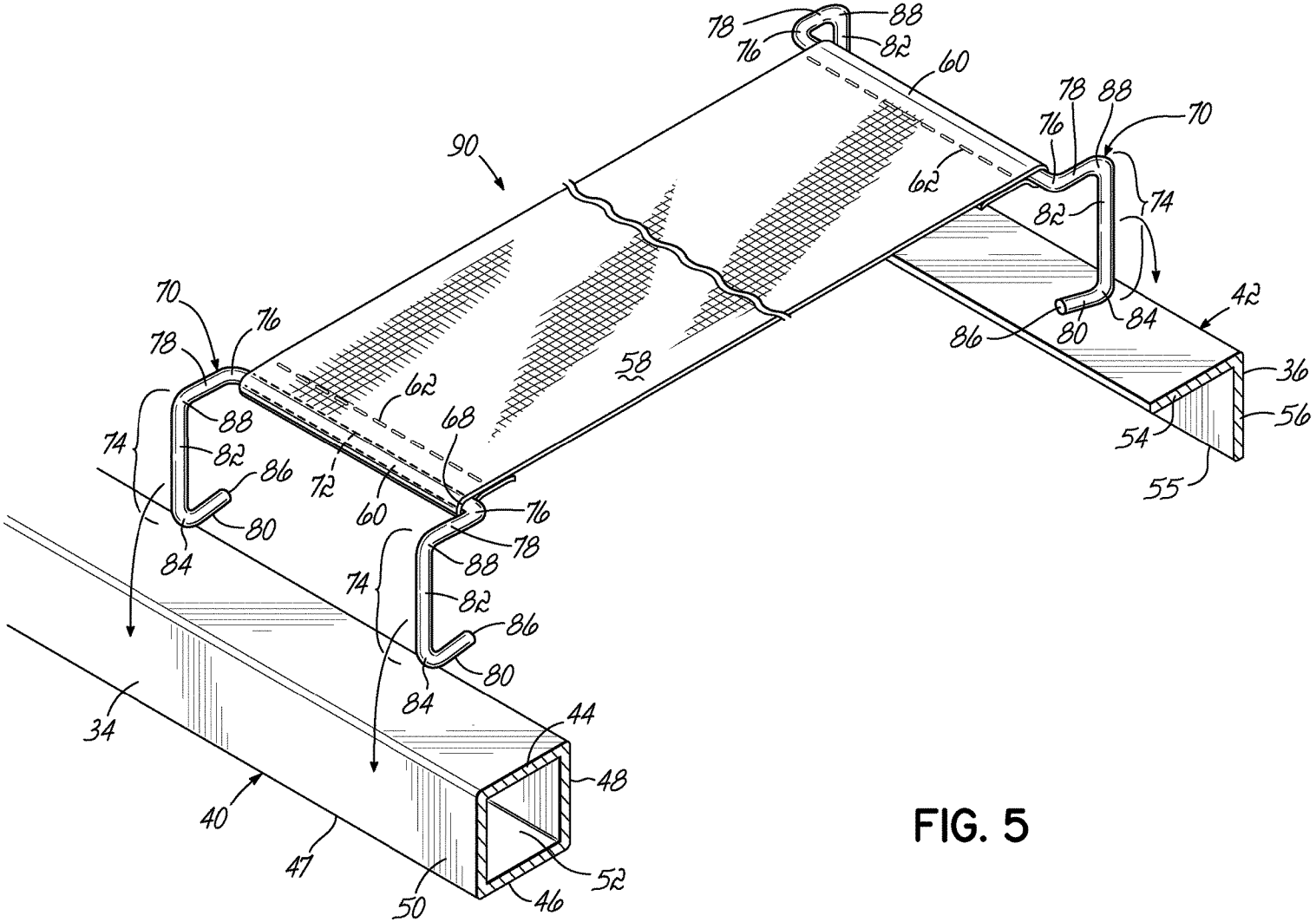
FIG. 5 is a perspective view, partially broken away, of one of the straps of webbing of the seating product being secured to a metal frame.

As best shown in FIG. 5, the generally U-shaped front piece 40 has a generally rectangular cross-section comprising a top wall 44, a bottom wall 46, an inner wall 48 and an outer wall 50 defining a hollow interior 52. As shown in FIG. 5, the linear rear frame piece 42 is generally L-shaped in cross-section, having a top wall 54 and a side wall 56 extending downwardly from an outer edge of the top wall 54.

Figure 4:
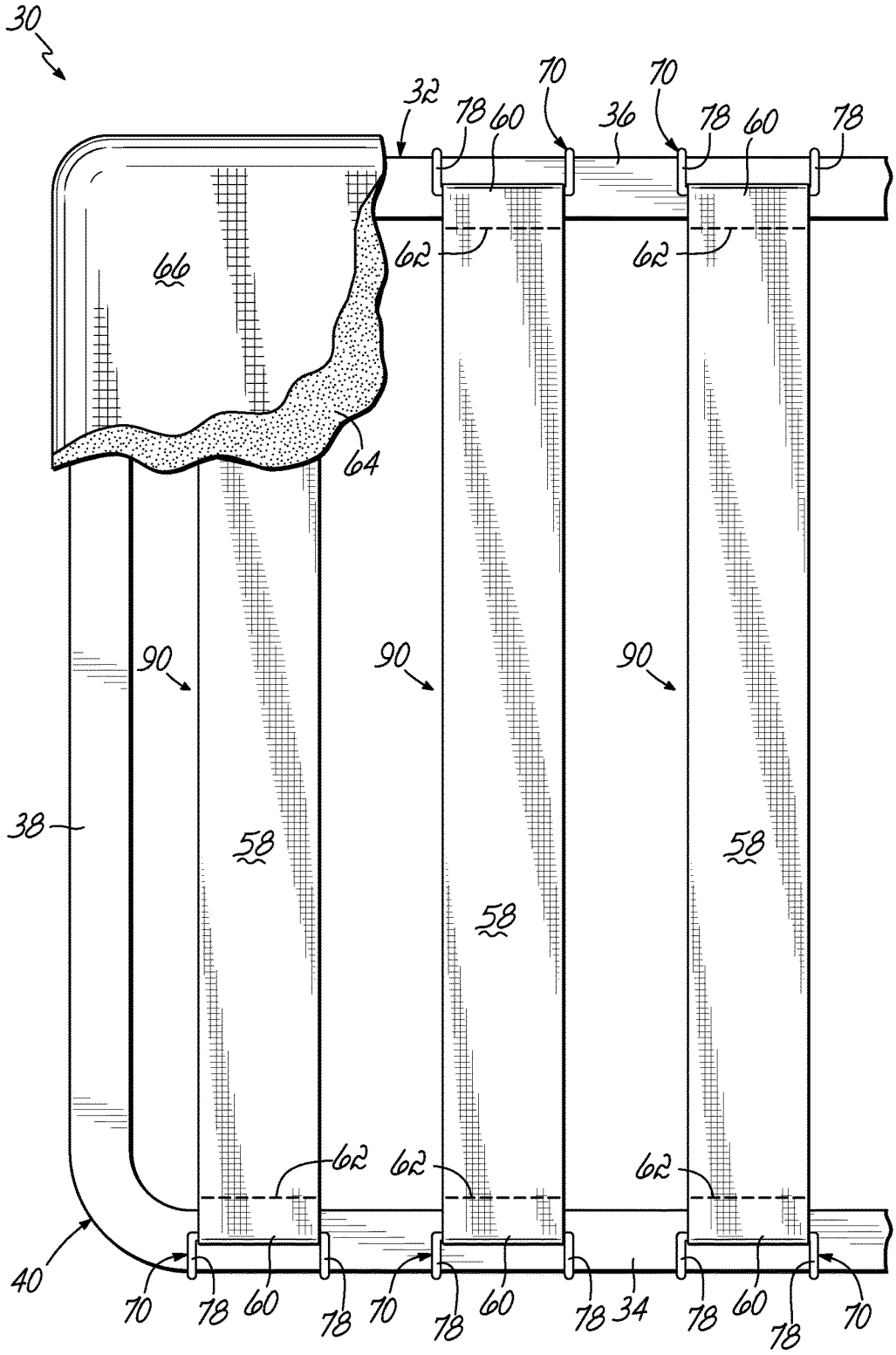
FIG. 4 is a top view, partially broken away, of the seating product of FIG. 3.

As best shown in FIGS. 3 and 4, seating product 30 further comprises a plurality of straps of webbing 58. Each strap of webbing 58 has opposed end loops 60, each end loop 60 being created by sewing or otherwise securing the strap of webbing to itself along a seam 62. Although the drawings illustrate five straps of webbing 58, any number of webbing straps of any desired width or length may be used in accordance with the present invention. A wire hook 70 passes through each of the end loops 60 and secures one end of one of the webbing straps 58 to the metal frame 32.

As shown in FIG. 4, one or more layers of padding 64, such as foam or other cushioning materials, may cover one or more surfaces of the seating product. An upholstered covering 66 encases or surrounds the metal frame 32, straps of webbing 58, wire hooks 70 and padding 64.

Figure 6A:
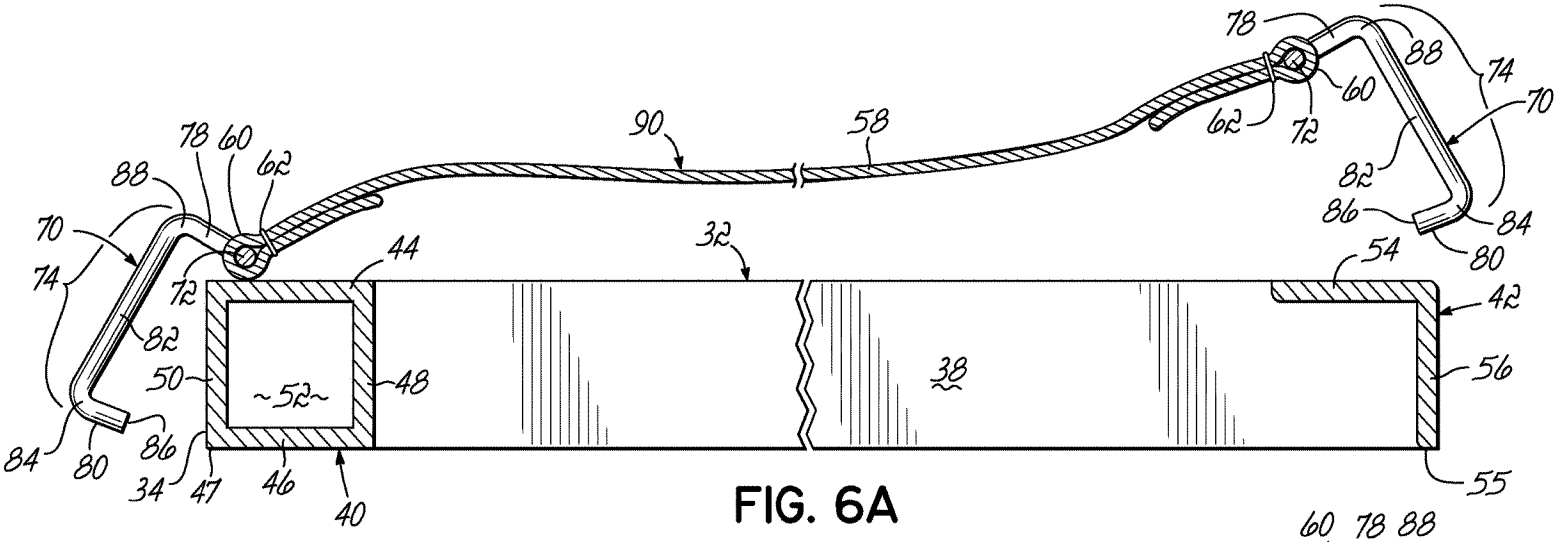
FIG. 6A is a cross-sectional view of one of the straps of webbing of the seating product being secured to a metal frame.
Figure 6B:
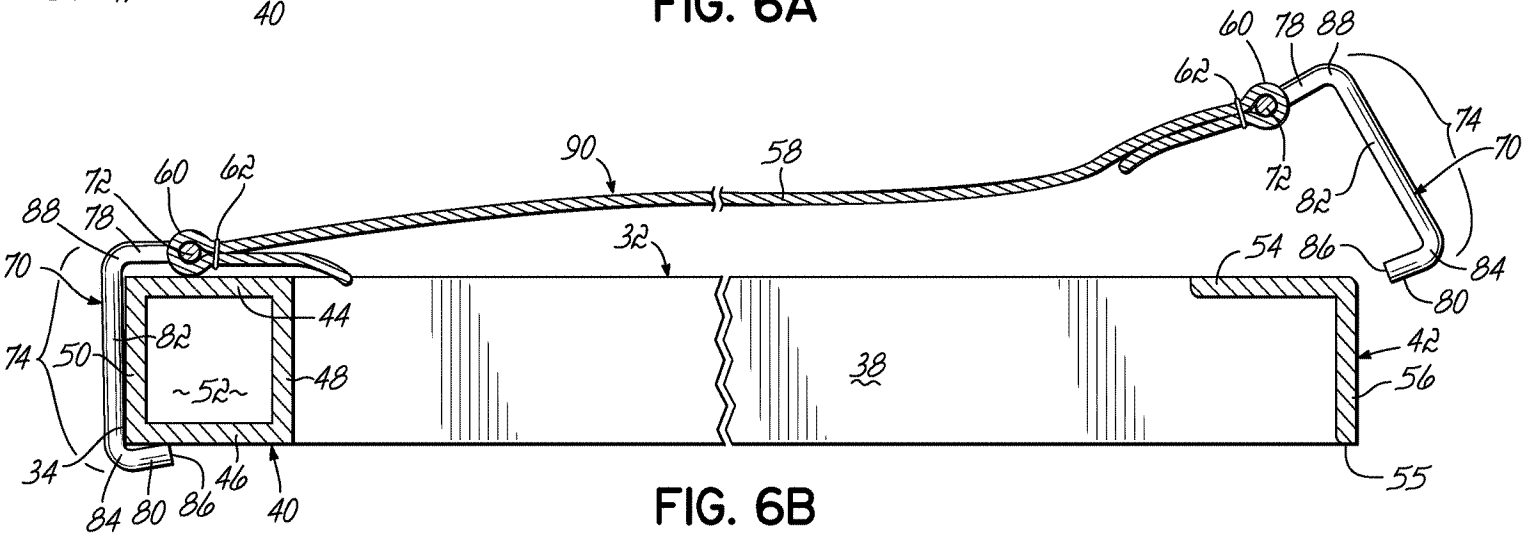
FIG. 6B is a cross-sectional view of the strap of webbing of FIG. 6A being further secured to the metal frame.
Figure 6C:
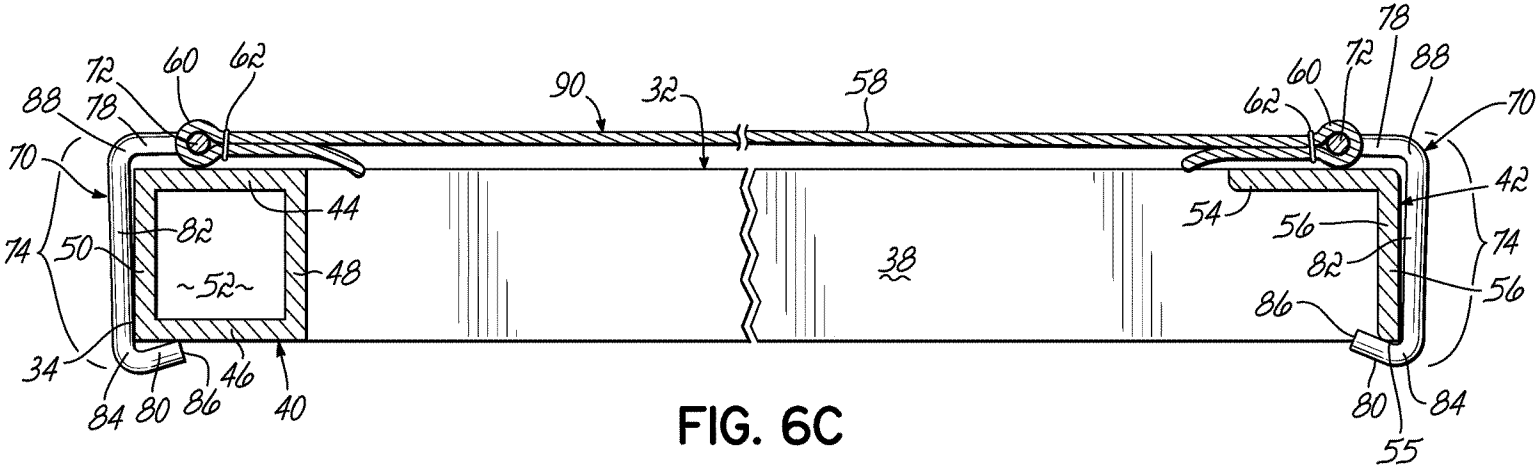
FIG. 6C is a cross-sectional view along the line 6C-6C of FIG. 3.
Figure 7A:
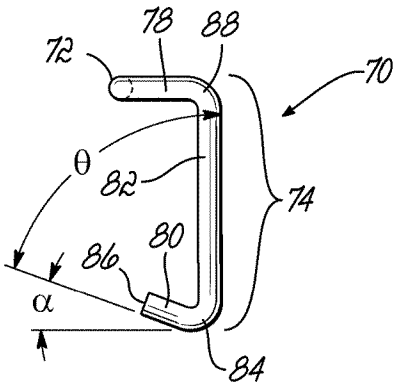
FIG. 7A is a side view of the wire hook of FIG. 7.
Figure 7:
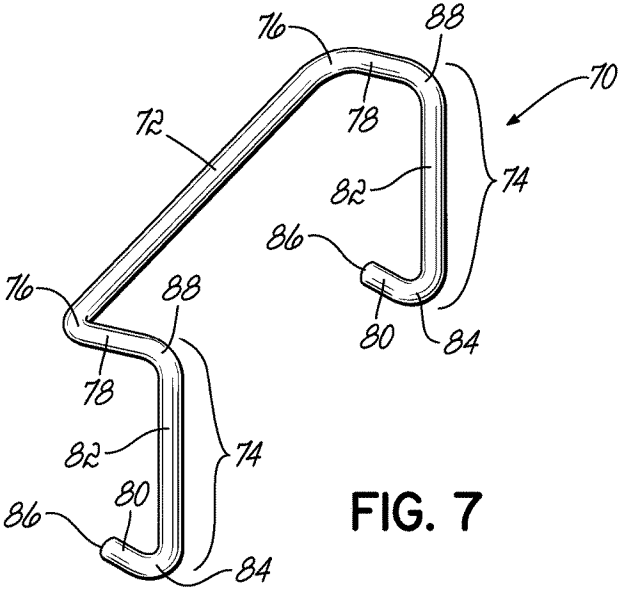
FIG. 7 is a perspective view of one of the wire hooks.

As best shown in FIG. 5, each wire hook 70 has a linear main portion 72, which extends through the interior 68 of one of the end loops 70 at the end of one of the straps of webbing 58. However, the main portion of each wire hook need not be straight; it may be another configuration. Each wire hook 70 further comprises two U-shaped portions 74, each U-shaped portion 74 extending outwardly from one of the opposed ends of the main portion 72 of the wire hook 70 at location 76. Each U-shaped portion 74 comprises an upper leg portion 78, a lower leg portion 80 and a connecting portion 82 extending between the upper and lower leg portions 78, 80. The upper leg portions 78 are generally parallel each other, each upper leg portion extending generally perpendicular to linear main portion 72. As shown in FIG. 7A, the lower leg portion 80 of each U-shaped portion 74 extends at an acute angle θ to connecting portion 68 to provide greater gripping ability, regardless of whether the wire hook 70 is engaged with the generally U-shaped piece 40 and/or the linear rear piece 42. As shown in FIG. 6C, this acute angle θ assists holding the wire hook 70 in a stationary position, the lower leg portions 80 of each U-shaped portion 74 of the wire hook 70 wrapping around the lower edge 55 of side wall 56 of the linear rear piece 42. The lower leg portion 80 begins at curved location 84 and terminates at end 86. Similarly, the upper leg portion 78 begins at curved location 76 and terminates at curved location 88.

For purposes of this document, a strap of webbing 58 and two wire hooks 70 are considered a strap assembly 90. FIGS. 5 and 6A-6C illustrate the method of securing one of the strap assemblies 90 to the steel frame 32 of seating product 30. As shown in FIGS. 5 and 6A, one of the wire hooks 70 is engaged with the lower wall 46 of the front 34 of the generally U-shaped front piece 40 of steel frame 32. More particularly, the lower leg portions 80 are hooked underneath the lower front edge 47 of lower wall 46 of the front 34 of the generally U-shaped front piece 40 of steel frame 32, such that the connecting portions 82 contact the outer wall 50 of the front 34 of the generally U-shaped front piece 40 of steel frame 32, as shown in FIGS. 6B and 6C. In the positions shown in FIGS. 6B and 6C, each of the upper leg portions 78 of each of the U-shaped portions 74 is spaced above the upper wall 44 of the front 34 of the generally U-shaped front piece 40 of steel frame 32.

As shown in FIG. 6B, once the U-shaped portions 74 are secured in place relative to the front 34 of the generally U-shaped front piece 40 of steel frame 32, the strap of webbing 58 is stretched from a relaxed condition to a stretched condition. The U-shaped portions 74 at the opposite end of the strap assembly 90 are then engaged with and hooked onto the linear rear frame piece 42, as shown in FIG. 5. More particularly, the U-shaped portions 74 are passed over the linear rear frame piece 42, such that the lower leg portions 80 pass underneath the lower edge 55 of side wall 56 of the linear rear frame piece 42 of steel frame 32, as shown in FIGS. 6B and 6C. As shown in FIG. 7A, the angle $\alpha$ between the lower leg portion 80 and a plane perpendicular to the connection portion 82 of each of the U-shaped portions 74 helps hold the wire hook 70 in place and prevents the wire hook 70 from disengaging from the linear rear frame piece 42 of steel frame 32 and/or disengaging from the front 34 of the generally U-shaped front piece 40 of steel frame 32. In the positions shown in FIGS. 6B and 6C, each of the connecting portions 82 of each of the U-shaped portions 74 contacts the side wall 56 of the linear rear frame piece 42 of steel frame 32 and are generally parallel to each other. However, each of the upper leg portions 78 of each of the U-shaped portions 74 is spaced above the top wall 54 of the linear rear frame piece 42 of steel frame 32 due to the thickness of the strap of webbing 58, thereby preventing unwanted metal-on-metal contact, known in the industry as "noise". The upper leg portions 78 of each of the U-shaped portions 74 are generally parallel to each other.

Once the wire hook 70 is engaged with the front 34 of the generally U-shaped front piece 40 of steel frame 32, the strap of webbing 58 is stretched toward the other side of the steel frame 32 and the other wire hook 70 of web assembly 90 engaged with the upper wall 54 of the linear rear frame piece 42 of steel frame 32, the tension created by the strap of webbing 58 locks the wire hooks 70 into position. There is no movement of the wire hooks 70, thereby eliminating noise and wear. There is no extra wire, nor extra bends, that can lead to deformation of the main section of the wire hook, thereby eliminating the need for collars. There is no part of the wire hook that is directly in contact with the padding or cushioning materials that may be applied to make an upholstered seat, eliminating a source of deterioration of the padding or cushioning materials.

Although the strap assemblies 90 are illustrated extending from front-to-back, those skilled in the art will appreciate that the strap assemblies 90 may extend from side-to-side. This document is not intended to limit the orientation of the frame and/or strap assemblies to those illustrated.

Although only certain exemplary embodiments of this invention have been described in detail above, those skilled in the art will readily appreciate that various modifications can be made without departing from the principles of the present invention. Accordingly, all such modifications are intended to be included within the scope of this invention.

What is claimed is:

1. A seating product comprising:

a metal frame having four sides;

a strap of webbing having two end loops;

a wire hook extending through each of the end loops wherein each of the wire hooks has a main portion inside one of the end loops of the strap of webbing and two parallel U-shaped portions, each of the U-shaped portions being joined to the frame without passing through the frame, being outside the metal frame and comprising upper and lower leg portions joined by a connecting portion, the upper leg portion of the U-shaped portion being above and contacting an upper wall of one of the sides of the metal frame, the connecting portion of the U-shaped portion contacting a side wall of the side of the metal frame, and the lower leg portion wrapping around a portion of the side of the metal frame.

2. The product of claim 1 wherein the lower leg portion of each of the wire hooks is shorter than the upper leg portion.

3. The product of claim 1 wherein each of the wire hooks comprises one piece of metal.

4. The product of claim 1 wherein the main portion of each of the wire hooks is straight.

5. The product of claim 1 wherein the strap of webbing is a woven material.

6. The product of claim 1 wherein the metal frame comprises multiple pieces.

7. The product of claim 6 wherein the metal frame comprises two pieces.

8. The product of claim 7 wherein one of the pieces is generally U-shaped.

9. The product of claim 1 wherein the strap of webbing is elastomeric.

10. A seating product comprising:

a metal frame having opposed sides;

multiple straps of elastomeric webbing, each strap of elastomeric webbing having two end loops;

a wire hook extending through each of the end loops wherein each of the wire hooks has a portion inside one of the end loops of the strap of webbing and two parallel U-shaped portions, each of the U-shaped portions being outside one of the sides of the metal frame and comprising upper and lower leg portions joined by a downwardly extending connecting portion extending outside a side wall of one of the sides of the metal frame, the upper leg portion being above an upper wall of the side of the metal frame, and the lower leg portion wrapped around a lower edge of the side of the metal frame, each of the wire hooks being secured to the frame at any desired location, thereby providing a desired spacing between adjacent straps of elastomeric webbing without a need for holes in the frame.

11. The product of claim 10 wherein at least one of the leg portions of each of the wire hooks contacts one of the sides of the metal frame.

12. The product of claim 10 wherein each of the wire hooks comprises one piece of metal.

13. The product of claim 10 wherein the lower leg portion of each of the wire hooks contacts a lower wall of one side of the metal frame.

14. The product of claim 10 wherein each strap of webbing is a woven material.

15. The product of claim 10 wherein the metal frame comprises multiple pieces.

16. The product of claim 15 wherein one of the pieces is made of angle iron.

17. The product of claim 10 wherein one of the pieces is generally U-shaped.

18. The product of claim 17 wherein the U-shaped piece has a hollow interior.

19. A seating product comprising:

a metal frame having a first side made of angle iron and a second side having a hollow interior;

multiple straps of elastomeric webbing, each strap of elastomeric webbing having two end loops;

a wire hook made of one piece of metal extending through each of the end loops wherein each of the wire hooks has a portion inside one of the end loops of the strap of webbing and two parallel U-shaped portions, each of the U-shaped portions being joined to the frame without passing through the frame, being outside the metal frame and comprising upper and lower leg portions joined by a downwardly extending connecting portion extending outside one of the sides of the metal frame, the upper leg portion being above an upper wall of one of the sides of the metal frame and the lower leg portion being below a lower edge of the side of the metal frame, each of the wire hooks being secured to the frame at any desired location, thereby providing a desired spacing between adjacent straps of elastomeric webbing without a need for holes in the frame.

20. The product of claim 19 wherein the portion of each of the wire hooks inside one of the end loops of the strap of webbing is straight.

* * * * *